US005462118A

United States Patent [19]

Jennings, Jr. et al.

[11] Patent Number: 5,462,118

[45] Date of Patent: Oct. 31, 1995

[54] METHOD FOR ENHANCED CLEANUP OF HORIZONTAL WELLS

[75] Inventors: Alfred R. Jennings, Jr., Plano; Michael R. Chambers, Bedford, both of Tex.

[73] Assignee: Mobil Oil Corporation, Fairfax, Va.

[21] Appl. No.: 342,318

[22] Filed: Nov. 18, 1994

[51] Int. Cl.[6] ..... E21B 37/00

[52] U.S. Cl. ..... 166/312; 166/50; 166/222

[58] Field of Search ..... 166/312, 50, 75.1, 166/222, 305.1

[56] References Cited

U.S. PATENT DOCUMENTS

| | | | |
|---|---|---|---|
| 4,060,130 | 11/1977 | Hart | 166/312 |
| 4,883,124 | 11/1989 | Jennings, Jr. | 166/307 |
| 4,909,325 | 3/1990 | Hopmann | 166/312 |
| 4,919,204 | 4/1990 | Baker et al. | 166/223 |
| 4,951,751 | 8/1990 | Jennings, Jr. | 166/285 |
| 5,086,842 | 2/1992 | Cholet | 166/312 |
| 5,090,481 | 2/1992 | Pleasants et al. | 166/312 X |
| 5,158,140 | 10/1992 | Ferry | 166/312 |
| 5,320,172 | 6/1994 | Jennings, Jr. | 166/312 X |

OTHER PUBLICATIONS

Effect of Foams Used During Carbonate Acidizing/by M. G. Bernadiner, K. E. Thompson and H. S. Fogler/Nov. 1992.

*Primary Examiner*—Hoang C. Dang

*Attorney, Agent, or Firm*—Alexander J. McKillop; George W. Hager, Jr.

[57] ABSTRACT

A method for improving the efficiency of horizontal wellbore cleanout of a horizontal wellbore drilled from a vertical wellbore, having a perforated liner cemented across the horizontal wellbore. The method includes running a coiled tubing into the horizontal wellbore. A first cleanup fluid is injected down the coiled tubing and a second cleanup fluid is injected down an annulus formed by the coiled tubing and the wellbore. The injection rates of the cleanup fluids in the coiled tubing and the annulus are balanced. The coiled tubing is moved back and forth over the horizontal wellbore.

10 Claims, 1 Drawing Sheet

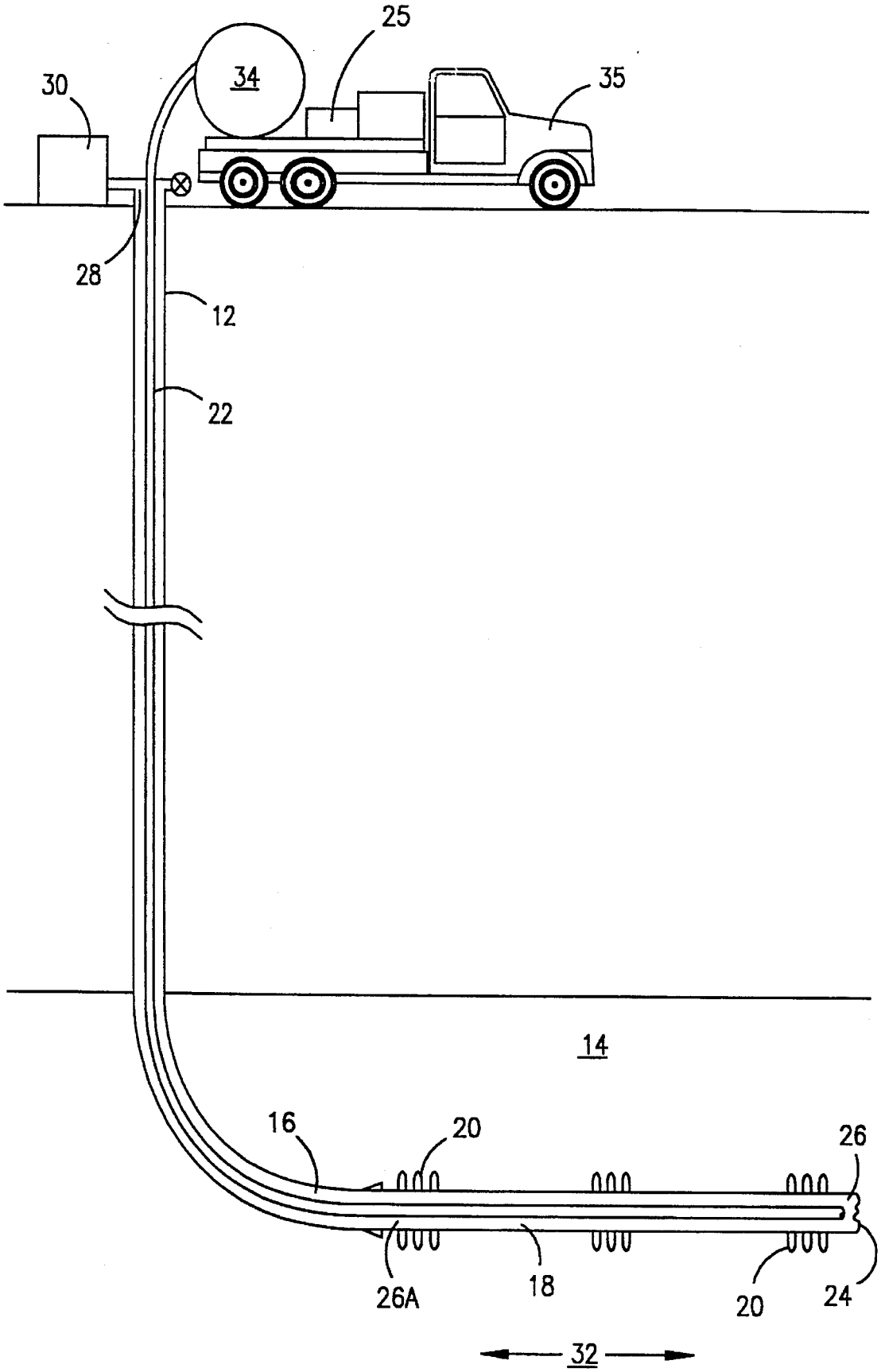
25
34
35
30
28
12
22
14
16
20
26
26A
18
20
24
32

METHOD FOR ENHANCED CLEANUP OF HORIZONTAL WELLS

BACKGROUND OF THE INVENTION

1. Field of the Invention

The present invention relates to formation cleanup and more particularly to a technique to greatly improve the efficiency of matrix acidizing and formation completion cleanup in horizontal wellbores.

2. Related Prior Art

With continued emphasis on drilling and completion of horizontal wellbores into a variety of oil and gas-bearing formations, cleanup of the wellbore and surrounding area is becoming increasingly important. A horizontal wellbore may become severely damaged by drilling mud invasion, loss of completion fluids, which is typically a weighted gel brine, or kill pill residue. If this happens, many of the original purposes of the horizontal wellbore, which are improved productivity, better reservoir drainage, minimization of water coning, etc., are lost.

Several methods are available in the industry to help clean up damage to horizontal wellbores, such as acidizing with foam diversion, placement of stimulation fluids with coiled tubing, etc. What is needed, however, is a method to improve the efficiency of the horizontal wellbore cleanout in order to take full advantage of the improved productivity afforded by the horizontal well.

There are methods for providing access to oil in difficult formations, particularly carbonate formations, and for repairing damage done to horizontal hydrocarbon producing wells that may occur during its hydrocarbon producing life. Several patents and articles are listed below that are indicative of the state of the art in production enhancement in carbonate formations in horizontal wells.

U.S. Pat. No. 4,883,124, titled "Method of Enhancing Hydrocarbon Production in a Horizontal Wellbore in a Carbonate Formation", issued to Alfred R. Jennings, Jr., relates to a two step process to stimulate a horizontal wellbore drilled into a carbonate formation. Initially, the wellbore is filled with acid. Because vertical communication exists in the vicinity of the wellbore, the acid enters into the fissures and cracks from the wellbore. Thereafter, a non-reactive displacement fluid, having a density greater than the acid, is injected into the wellbore. This more dense displacement fluid selectively pushes the acid to greater depths into the formation so carbonate dissolution can take place which substantially increases the formation's permeability. Increased permeability enhances the production of hydrocarbonaceous fluids.

U.S. Pat. No. 4,951,751, titled "Diverting Technique to Stage Fracturing Treatments in Horizontal Wellbores", issued to Alfred R. Jennings, Jr., relates to a method for staging a fracturing treatment in a horizontal wellbore where solidified gel is used as a diverting medium. A desired section of the horizontal wellbore farthest removed from the angle of deviation from vertical of the wellbore is perforated. Through perforations contained in the horizontal section, the desired interval is fractured hydraulically. The gel is displaced with a "wiper plug" and the gel confined to the fractured interval and wellbore area adjacent the fractured interval. Here the gel forms a solid gel in the interval and a gel plug in the wellbore. Afterwards, another section of the horizontal well is perforated. Thereafter, a second desired interval is fractured. After completion of the fracturing process, the gel plug breaks and the "wiper plug" is pumped to the farthest end of the horizontal wellbore.

"Effect of Foams Used During Carbonate Acidizing" by M. G. Bernadiner, SPE, K. E. Thompson, SPE, and H. S. Fogler, SPE, U. of Michigan, published in *SPE Production Engineering,* November 1992, states that although acidization has been used successfully for many years to increase the productivity of petroleum wells in carbonate formation, demands on the performance and application of the acidizing process are increasing. This study investigated a method of in-situ foam generation that allows deeper wormhole penetration yet uses less acid than conventional methods. The dissolution patterns were imaged with neutron radiography, which provided an in depth understanding of the effects of foam and other critical parameters. Results show that foam is effective in promoting efficient stimulation, even at low acid injection rates.

SUMMARY OF THE INVENTION

The present invention provides a method for improving the efficiency of the cleanout of a horizontal wellbore which has been drilled into a producing formation and which may have a perforated production liner cemented across the horizontal portion of the wellbore or may have a pre-drilled liner that is not cemented or may simply be an open hole completion. The method of the present invention includes the steps of running a coiled tubing into the horizontal wellbore. A first cleanup fluid is injected down the coiled tubing. Down an annulus formed by the coiled tubing and the production liner is injected a second cleanup fluid. The injection rates of the cleanup fluids in the coiled tubing and the annulus may be balanced or varied depending upon the result desired. The coiled tubing may then be moved back and forth over the horizontal wellbore to assure cleanup of the entire horizontal section.

BRIEF DESCRIPTION OF THE DRAWINGS

The attached Figure is an illustration of a cross section of a horizontal wellbore in a typical oil producing formation.

DESCRIPTION OF THE PREFERRED EMBODIMENT

As stated previously, with continued emphasis on drilling and completion of horizontal wellbores into a variety of oil and gas-bearing formations, cleanup of the wellbore and surrounding area is becoming increasingly important. Due to its orientation with respect to gravitational forces, a horizontal wellbore may become severely damaged by drilling mud invasion, loss of completion fluids, etc. In a vertical wellbore, more dense obstructions eventually fall to the bottom of the well and problems such as drilling mud invasion rely on sideward migration. In a horizontal well, these obstructions fall to the bottom or what would have been the side of a vertical wellbore and drilling mud invasion is aided by gravitational forces. When this happens, some of the benefits which suggested a horizontal wellbore originally are lost.

While methods are available in the art to clean up horizontal wellbores, such as acidizing with foam diversion, placement of stimulation fluids with coiled tubing, etc., the present invention provides a method for improved efficiency in horizontal wellbore cleanout to take full advantage of its improved productivity.

As stated previously, a horizontal wellbore is sometimes drilled in order to increase the production of a well in an oil formation. When a sizeable oil reservoir is located, a vertical wellbore is drilled, bending to the horizontal as the formation having the reservoir is approached.

Referring now to the attached Figure, a typical horizontal wellbore is illustrated in cross sectional form. In the Figure, a vertical wellbore 12 is drilled into producing formation 14. At a predetermined depth, the drill bit is gradually directed toward the horizontal direction and horizontal wellbore 16 is drilled. In the illustration, a ninety degree angle is shown, however, in practice the change from vertical to horizontal may take several hundred feet.

Upon finishing the wellbore, a liner 18 is cemented across horizontal wellbore 16. Horizontal wellbore 16 and its associated production liner 18 is perforated with perforations 20. Production liner 18 may take the form of a slotted liner or a pre-packed screen. In some instances, the well may be merely an open hole completion. Only in the case where a solid liner has been cemented in place, must the liner be perforated. The amount of perforations and their density can be varied to increase production, depending on the formation and its solidity, porosity, permeability etc.

For the cleanup treatment, coiled tubing 22 is run into vertical wellbore 12 to end 24 of horizontal wellbore 16. Coiled tubing may be anywhere from one inch to two inches carbon steel tubing, however any type currently in use in the art is acceptable. Coiled tubing 22 is connected to a designated positive displacement pump 25, such as those commonly in use in the art. The only requirement for positive displacement pump 25 is that it be capable of maintaining enough pressure on a cleanup fluid 26. Cleanup fluid 26 is pumped down coiled tubing 22 to the damaged area of horizontal wellbore 16. Wellbore cleanout fluid 26 may be of any type, such as mineral acid, organic acid, or hydrocarbon solvent.

While injection of cleanup fluid 26 is taking place down coiled tubing 22, injection of a similar cleanup fluid 26A down annulus 28 formed by coiled tubing 22 and production liner 18 is begun. Annulus 28 is connected to a separate designated positive displacement pump 30, which, as the positive displacement pump connected to coiled tubing 22, may be of any type currently in use in the art.

The purpose of cleanup fluid 26A is to maintain pressure on the fluid downhole to assure that the cleanup fluid is forced into the formation near the end of coiled tubing. If pressure were not maintained, the acid cleanup fluid 26 probably would enter the formation at only one point. In the case of carbonate formations, the acid would continue to enter the formation at its initial point due to its reaction with the carbonates.

The injection rates in coiled tubing 22 and annulus 28 are then balanced between the two injection points. Coiled tubing 22 is reciprocated back and forth over section 32 of horizontal wellbore 16 while injecting cleanup fluid volumes. A coiled tubing unit, such as a truck 35 that the coil of tubing 22 is located, is used to facilitate moving coiled tubing 22 back and forth across horizontal wellbore 16 while pumping cleanup fluid 26 down coiled tubing 22. This can be accomplished by something as simple as rotating a spool 34 on truck 35 clockwise and counter-clockwise while pumping cleanup fluid 26 down coiled tubing 22.

Variations to the method of the present invention include modifications such as, pumping fluids down coiled tubing 22 and coiled tubing/production liner annulus 28 which have different properties, such as viscosity, fluid density, acid reaction rate, etc., to improve efficiency of fluid placement. Also, a variety of diverting agents, either solids, viscous gels, or foams, could be pumped down coiled tubing 22 to divert treating fluid and change fluid injection profile along horizontal wellbore 16. In addition, the size of coiled tubing 22 and coiled tubing/production tubing annulus 28 could be varied to enhance technique in certain applications. And also, injection rates down coiled tubing 22 compared to the coiled tubing/production liner annulus 28 can be varied to influence distribution of fluid based on formation properties (i.e. permeability) across the horizontal wellbore section. Furthermore, the rate of movement of coiled tubing 22 across horizontal wellbore 16 can be varied during the treatment. The placement and density of perforations 20 along horizontal wellbore 16 can also be varied. The type of completion across horizontal wellbore 16 can be of several types, cemented and cased hole with perforations, slotted liner, pre-packed screen, and open hole completion, without affecting the efficiency of the method of the present invention.

While there has been illustrated and described a particular embodiment of the present invention, it will be appreciated that numerous changes and modifications in addition to those listed will occur to those skilled in the art, and it is intended in the appended claims to cover all those changes and modifications which fall within the true spirit and scope of the present invention.

We claim:

1. A method for improving the efficiency of horizontal wellbore cleanout in a horizontal wellbore drilled from a vertical wellbore comprising the steps of:

running a coiled tubing into said horizontal wellbore;

injecting a first cleanup fluid down said coiled tubing;

injecting a second cleanup fluid down an annulus formed by said coiled tubing and said wellbore;

balancing injection rates in said coiled tubing and said annulus; and reciprocating said coiled tubing back and forth over said horizontal wellbore.

2. The method according to claim 1 also including the step of:

varying the properties of said first cleanup fluid and said second cleanup fluid.

3. The method according to claim 1 also including the step of:

varying the size of said coiled tubing.

4. The method according to claim 1 wherein said step of balancing said injection rates includes the step of:

varying said injection rates.

5. The method according to claim 1 wherein said step of reciprocating said coiled tubing includes the step of:

varying the rate of reciprocation of said coiled tubing.

6. A system for improving the efficiency of horizontal wellbore cleanout in a horizontal wellbore drilled from a vertical wellbore comprising:

a coiled tubing placed into the horizontal wellbore;

means for injecting a first cleanup fluid down said coiled tubing;

means for injecting a second cleanup fluid down an annulus formed by said coiled tubing and said wellbore;

means for balancing injection rates in said coiled tubing and said annulus; and means for reciprocating said coiled tubing back and forth over said horizontal wellbore.

7. The system according to claim 6 also including:

means for varying the properties of said first cleanup fluid and said second cleanup fluid.

8. The system according to claim 6 also including:

means for varying the size of said coiled tubing.

9. The system according to claim 6 wherein said means for balancing said injection rates includes:

means for varying said injection rates.

10. The system according to claim 6 wherein said means for reciprocating said coiled tubing includes:

means for varying the rate of reciprocation of said coiled tubing.

* * * * *